US008156919B2

(12) United States Patent
Darrow

(10) Patent No.: US 8,156,919 B2
(45) Date of Patent: Apr. 17, 2012

(54) ROTARY VANE ENGINES WITH MOVABLE ROTORS, AND ENGINE SYSTEMS COMPRISING SAME

(76) Inventor: David S. Darrow, Princeton, NJ (US)

( * ) Notice: Subject to any disclaimer, the term of this patent is extended or adjusted under 35 U.S.C. 154(b) by 48 days.

(21) Appl. No.: 12/342,993

(22) Filed: Dec. 23, 2008

(65) Prior Publication Data

US 2012/0048230 A1 Mar. 1, 2012

(51) Int. Cl.

| | |
|---|---|
| ***F02B 53/00*** | (2006.01) |
| ***F02B 53/02*** | (2006.01) |
| ***F02G 1/00*** | (2006.01) |
| ***F01C 21/10*** | (2006.01) |
| ***F04C 2/00*** | (2006.01) |
| ***F04C 18/00*** | (2006.01) |

(52) U.S. Cl. ..... 123/243; 123/241; 60/650; 418/150; 418/256; 418/263; 418/268; 418/269

(58) Field of Classification Search ..... 123/224, 123/228–229, 231, 234, 236, 241, 243; 418/150, 418/178, 256, 259–260, 263, 268–269; 60/39.63, 60/650; *F02B 53/00, 53/02*
See application file for complete search history.

(56) References Cited

U.S. PATENT DOCUMENTS

| | | | | |
|---|---|---|---|---|
| 1,968,694 | A | 7/1934 | Leibing | |
| 1,983,971 | A | 12/1934 | Doherty | |
| 3,193,190 | A * | 7/1965 | Linberg | 418/86 |
| 3,204,563 | A | 9/1965 | Eickemeyer | |
| 3,301,233 | A * | 1/1967 | Dotto et al. | 123/243 |
| 3,535,872 | A * | 10/1970 | Kelly | 60/519 |
| 3,589,841 | A * | 6/1971 | De Lisse | 418/46 |
| 3,651,641 | A | 3/1972 | Ginter | |
| 3,708,976 | A | 1/1973 | Berlyn | |
| 3,756,763 | A | 9/1973 | Elmore et al. | |
| 3,774,397 | A | 11/1973 | Engdahl | |
| 3,799,707 | A * | 3/1974 | Newton | 418/77 |
| 3,809,020 | A * | 5/1974 | Takitani | 123/243 |
| 3,877,854 | A * | 4/1975 | Sasame et al. | 418/178 |
| 3,886,734 | A | 6/1975 | Johnson | |
| 3,890,070 | A * | 6/1975 | Sasame et al. | 418/178 |
| 3,893,295 | A | 7/1975 | Airas | |
| 3,939,652 | A | 2/1976 | Hubers | |
| 3,958,419 | A * | 5/1976 | Laing | 60/397 |
| 4,009,573 | A * | 3/1977 | Satz | 60/519 |
| 4,015,424 | A | 4/1977 | Shinohara | |
| 4,077,221 | A * | 3/1978 | Maeda | 60/650 |

(Continued)

FOREIGN PATENT DOCUMENTS

JP 57-122190 7/1982

(Continued)

OTHER PUBLICATIONS

Machine Translation of Toritsuka et al. (Pub.No. JP 10-068301 A, Published on Mar. 10, 1998.*

(Continued)

*Primary Examiner* — Thai Ba Trieu
(74) *Attorney, Agent, or Firm* — Fox Rothschild LLP

(57) ABSTRACT

Embodiments of rotary vane engines include rotors that rotate about an axis of rotation. The rotors can be moved in directions substantially perpendicular to the axis of rotation to vary expansion and/or compression ratios of the rotary vane engines. The ability to vary the expansion and/or compression ratios can facilitate optimization of the performance of the rotary vane engines as operating conditions vary.

19 Claims, 10 Drawing Sheets

U.S. PATENT DOCUMENTS 4,357,800 A * 11/1982 Hecker ..... 60/519
4,402,653 A * 9/1983 Maruyama et al. ..... 418/76
4,509,905 A * 4/1985 Maruyama et al. ..... 418/259
4,553,513 A * 11/1985 Miles et al. ..... 123/234
4,566,411 A 1/1986 Summerlin
4,592,309 A 6/1986 Williams
4,653,273 A 3/1987 David
4,672,813 A * 6/1987 David ..... 418/99
4,776,778 A * 10/1988 Iio et al. ..... 418/84
4,804,317 A * 2/1989 Smart et al. ..... 418/110
4,864,814 A 9/1989 Albert
4,867,658 A * 9/1989 Sugita et al. ..... 418/268
4,890,585 A 1/1990 Hathorn
5,121,607 A 6/1992 George
5,144,802 A * 9/1992 Ruzic ..... 418/260
5,302,096 A * 4/1994 Cavalleri ..... 418/150
5,311,739 A 5/1994 Clark
5,410,998 A 5/1995 Paul et al.
5,524,586 A 6/1996 Mallen
5,524,587 A * 6/1996 Mallen et al. ..... 123/243
5,568,796 A * 10/1996 Palmer ..... 418/241
5,711,268 A * 1/1998 Holdampf ..... 123/243
5,839,270 A * 11/1998 Jirnov et al. ..... 60/39.182
6,012,280 A 1/2000 Hufton
6,024,549 A * 2/2000 Lee ..... 418/256
6,053,716 A * 4/2000 Riegger et al. ..... 418/63
6,092,365 A 7/2000 Leidel
6,094,915 A 8/2000 Negre et al.
6,305,159 B1 10/2001 Nagel
6,336,317 B1 1/2002 Holtzapple et al.
6,349,695 B1 * 2/2002 Lee ..... 123/224
6,397,579 B1 6/2002 Negre
6,412,273 B1 7/2002 Rohs
6,422,196 B1 7/2002 Pien
6,449,940 B2 9/2002 Nagel
6,530,211 B2 3/2003 Holtzapple et al.
6,584,759 B1 * 7/2003 Heap ..... 60/39.44
6,599,113 B1 * 7/2003 Lee ..... 418/256
6,622,471 B1 9/2003 Nagel
6,655,327 B1 12/2003 Hedman
6,684,847 B1 * 2/2004 Al-Hawaj ..... 123/243
6,691,655 B2 2/2004 Aoyama et al.
6,766,783 B1 * 7/2004 Person et al. ..... 123/236
6,776,136 B1 * 8/2004 Kazempour ..... 123/243
6,886,326 B2 5/2005 Holtzapple et al.
6,951,211 B2 10/2005 Bryant
6,952,923 B2 10/2005 Branyon et al.
6,959,685 B2 * 11/2005 Person et al. ..... 123/236
6,986,329 B2 1/2006 Scuderi et al.
7,140,853 B2 * 11/2006 Al Hawaj ..... 123/243
2002/0179037 A1 12/2002 Nagel
2003/0062020 A1 4/2003 Okulov
2003/0121494 A1 * 7/2003 Yosikane ..... 123/243
2003/0145809 A1 8/2003 Janhunen
2004/0035384 A1 2/2004 Moe
2005/0079084 A1 4/2005 Patterson ..... 418/268
2005/0126519 A1 6/2005 Artola
2005/0142250 A1 6/2005 Garwood
2006/0144356 A1 7/2006 Sellnau et al.
2007/0215094 A1 9/2007 Sumiyuki ..... 123/243
2009/0087334 A1 * 4/2009 Whitesell ..... 418/136
2009/0291000 A1 * 11/2009 Saga et al. ..... 418/24
2009/0313989 A1 * 12/2009 Doss ..... 60/519

FOREIGN PATENT DOCUMENTS

JP 10-068301 3/1998
RU 2028476 C1 2/1995
WO 01-46591 6/2001

OTHER PUBLICATIONS

International Search Report Date of Actual Completion of Internal Search: Aug. 9, 2010.

* cited by examiner

ROTARY VANE ENGINES WITH MOVABLE ROTORS, AND ENGINE SYSTEMS COMPRISING SAME

TECHNICAL FIELD

The present application relates to rotary vane engines that produce torque as a result of the expansion of gases therein, and engine systems that incorporate rotary vane engines.

BACKGROUND

Engine systems that include rotary vane engines (hereinafter referred to as "rotary vane engine systems") possess various advantages in relation to engines such as Otto, diesel, and Sterling-cycle engines, gas turbines, and steam engines.

For example, Otto-cycle engines require a minimum fuel to air ratio to achieve combustion. The minimum fuel to air ratio at which combustion can be achieved typically results in incomplete combustion. Incomplete combustion produces relatively large amounts of carbon monoxide (CO) in the exhaust, and can necessitate the use of a catalytic converter to remove some or all of the CO form the exhaust. Rotary vane engine systems, by contrast, can operate with a combustion process that provides complete combustion with excess oxygen present in the exhaust, without the use of catalytic converters or other pollution-control devices.

Moreover, the fuel used in an Otto-cycle engine needs to be formulated so that the fuel will not combust prematurely, i.e., at a pressure or temperature lower than the operating respective pressure and temperature of the engine. Premature combustion is commonly known as "pre-ignition knock." Pre-ignition knock can substantially reduce engine efficiency, and can damage the engine. Rotary vane engine systems are not susceptible to pre-ignition knock, and can generally use any type of fuel that releases sufficient energy during combustion to drive the rotary vane engine, including crude oil and dried wood.

Approximately one third-of the energy released in an Otto-cycle engine by the combustion of fuel can exit the engine as unused energy via the engine exhaust. Some of this energy could be recovered if the expansion ratio within the engine's cylinders could be made greater than the compression ratio. Because compression and expansion occur in the same cylinder in an Otto-cycle engine, achieving different expansion and compression ratios would require that the compression process begin under a partial vacuum. Starting the compression process under a partial vacuum, however, would substantially reducing the overall power produced by the engine. The compression and expansion processes in rotary vane engine systems, by contrast, can be performed in separate mechanical devices that readily facilitate the use of different compression and expansion ratios.

The combustion temperature in an Otto-cycle engine is relatively high, which can result in high nitrogen oxide (NOX) emissions. Because NOX is a prime contributor to smog, exhaust gas recycling and other provisions may be needed to reduce the NOX emissions to acceptable levels. Rotary vane engine systems, by contrast, can be configured so that the combustion temperature can be continuously varied, thereby facilitating lower NOX emissions and increased fuel efficiency.

The dwell time of the fuel-air mixture in an Otto-cycle engine, in general, is relatively short, particularly at high engine speeds. The short dwell time can result in unburned fuel exiting the exhaust, potentially resulting in unsatisfactory emission levels and necessitating the use of a catalytic converter or other pollution-control devices. The dwell time of the fuel in a rotary vane engine systems can be substantially longer than in an Otto-cycle engine, thereby promoting complete combustion of the fuel.

The compression ratio in typical diesel-cycle engines can be approximately 20:1. Fuel is sprayed into each cylinder after the air therein is compressed, and the resulting fuel-air mixture is combusted. Diesel engines have no throttle to limit intake the intake pressure below ambient, and the expansion ratio in a typical diesel-cycle engine is usually about equal to the compression ratio. The relatively high compression ratio in diesel engines can result in relatively high NOX emissions. The compression and expansion processes in rotary vane engine systems, as discussed above, can be performed in separate mechanical devices that readily facilitate the use of a compression ratio that is lower than the expansion ratio.

Moreover, the dwell time of the fuel-air mixture in a diesel-cycle engine is relatively short. Although additives such as cetane improvers can be introduced into the fuel to hasten the combustion process, incomplete combustion manifested as soot in the engine exhaust is common in diesel-cycle engines. The dwell time of the fuel in a rotary vane engine systems can be substantially longer than in a diesel-cycle engine, thereby promoting complete combustion of the fuel.

Diesel fuels typically have a relatively high boiling point, which can inhibit the tendency of the fuel to vaporize. Accordingly, diesel fuel is usually injected into the cylinder as a high-pressure spray to facilitate vaporization. The equipment needed to control and otherwise facilitate the fuel injection process can be relatively complex and expensive, however, due to need to vary the amount of fuel injected as the speed and timing of the engine change. Rotary vane engines, as discussed above, can generally use any type of fuel that releases sufficient energy during combustion to drive the rotary vane engine, and the relatively long dwell-time of the fuel-air mixture in rotary vane engine systems can promote complete combustion of the fuel.

Diesel and Otto-cycle engines typically require some type of liquid or air cooling. The energy transferred out of the engines as heat during the cooling process represents an energy loss. The need to cool diesel and Otto-cycle engines results in part from the use of lubricants within the engines. In particular, most lubricants degrade at the operating temperatures of a typical diesel or Otto-cycle engine, thereby necessitating engine cooling to avoid subjecting the lubricants to excessive temperatures. Rotary vane engine systems, by contrast, can operate at temperatures that are less than half the operating temperature of a typical diesel or Otto-cycle engine. Thus, the cooling requirements for rotary vane engine systems, and the energy losses associated therewith, are usually less than those of a diesel or Otto-cycle engine. Moreover, the relatively low operating temperatures of rotary vane engine systems can eliminate the need for a lubrication system in some applications.

The combustion process in steam and Sterling-cycle engines does not occur in the gas that is expanded to produce a work output. Thus, the efficiency of the heat-transfer process from the fuel to the working fluid is relatively poor. By contrast, the fuel in rotary vane engine systems is mixed and combusted with the air that is to be expanded. Thus, nearly all of the energy released from the fuel during combustion can be used to heat the working fluid.

Gas turbine engines typically use a turbine that extracts energy from a high-pressure, high-temperature gas by impulse (direction change), reaction (acceleration), or a combination thereof. The turbine typically operates at relatively high rotational speeds, to avoid excessive by-pass of the gas past the turbine blades and the accompanying energy losses. The expanding gases in rotary vane engine systems, by contrast, are typically confined by vanes that are able to effectively confine the gases at low rotational speeds.

Rotary vane engine systems may be subjected to operating conditions, e.g., torque outputs, rotational speeds, etc., that vary widely during normal operation. Although rotary vane engine systems possess substantial advantages in relation to other types of engine systems, a typical rotary vane engine system cannot operate optimally, e.g., at maximum thermal efficiency, as it operating conditions vary. Consequently, an ongoing need exists for rotary vane engine systems having operating characteristics that can be optimized as operating conditions vary.

SUMMARY

Embodiments of rotary vane engines comprise rotors that rotate about an axis of rotation. The rotors can be moved in directions substantially perpendicular to the axis of rotation to vary expansion and/or compression ratios of the rotary vane engines. The ability to vary the expansion and/or compression ratios can facilitate optimization of the performance of the rotary vane engines as operating conditions vary.

Other embodiments of rotary vane engines comprise a housing; and a rotor mounted in the housing and rotatable in relation to the housing about an axis of rotation. The rotor is movable in relation to the housing in a direction substantially perpendicular to the axis of rotation.

Other embodiments of rotary vane engines comprise a housing; and a rotor mounted for rotation within the housing and comprising a plurality of vanes. The vanes and the housing define a plurality of chambers for expanding a pressurized gas to impart rotation to the rotor. A volume of each of the chambers in relation an angular position of the chamber is variable so that an expansion ratio of the pressurized gas can be varied.

Other embodiments of rotary vane engines comprise a housing; and a rotor mounted within the housing and rotatable in relation to the housing about an axis of rotation. The rotor comprises a shaft and plurality of vanes mounted on the shaft. The vanes and the housing defining a plurality of chambers each having a volume that receives a pressurized gas. The rotary vane engines further comprise at least one of: a hydraulic actuator; a screw jack; a pneumatic cylinder; a cam; a ramp; and a lobe coupled to the rotor for moving the rotor in a direction substantially perpendicular to the axis of rotation so that a volume of the chambers in relation to an angular position of the chambers can be varied.

BRIEF DESCRIPTION OF THE DRAWINGS

The foregoing summary, as well as, the following detailed description of preferred embodiments, are better understood when read in conjunction with the appended drawings. The drawings are presented for illustrative purposes only, and the scope of the appended claims is not limited to the specific embodiments shown in the drawings. In the drawings:

DETAILED DESCRIPTION

Figure 1:
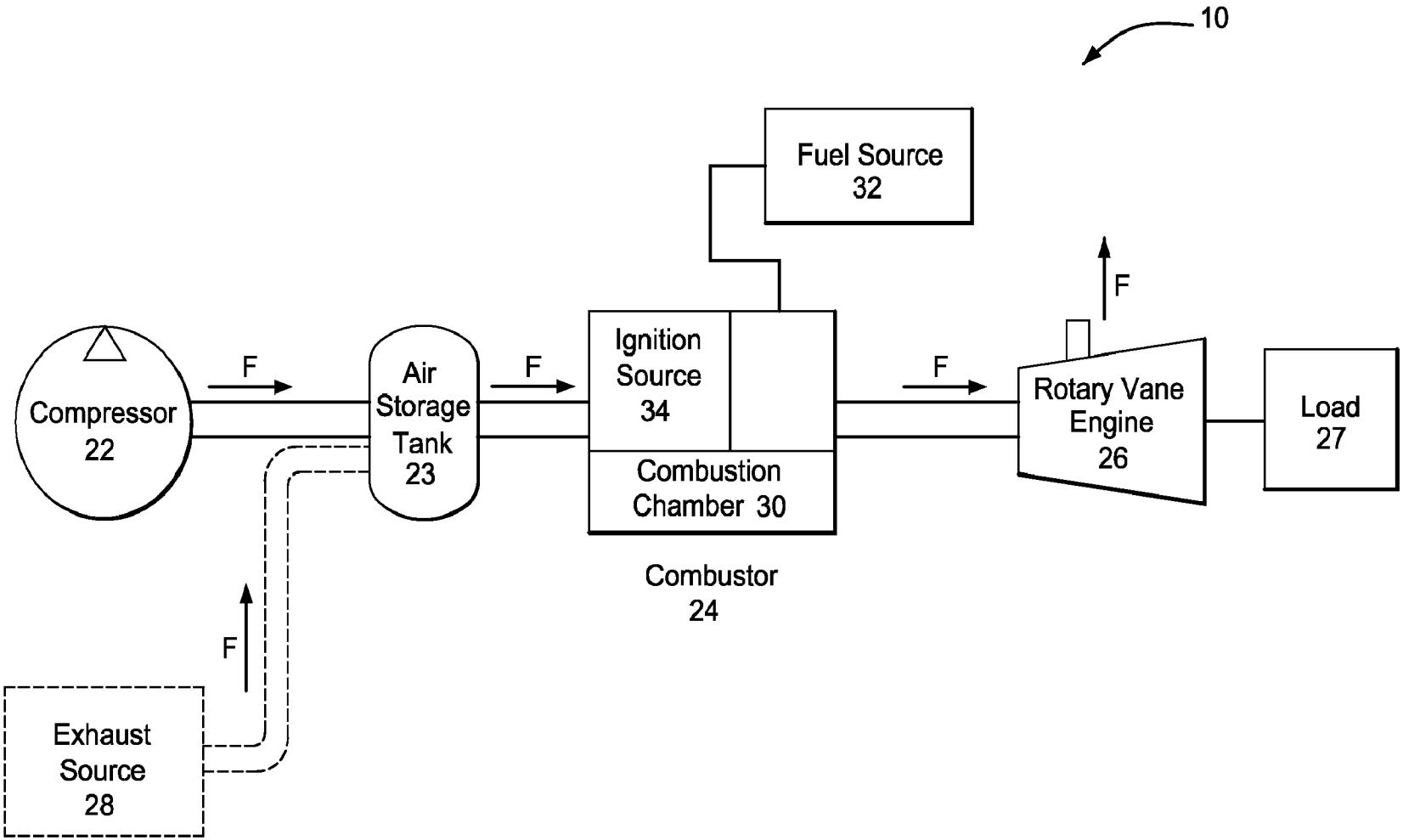
FIG. 1 is a diagrammatic depiction of an embodiment of an engine system comprising a rotary vane engine.

FIGS. 1-7 depict an embodiment of an engine system 10. The engine system 10 comprises a compressor 22, and an air storage tank 23 in fluid communication with the compressor 22, as shown in FIG. 1. The engine system 10 also includes a combustor 24 in fluid communication with the air storage tank 23.

The engine system 10 also includes a rotary vane motor 26, shown in FIGS. 1-5. The compressor 22, air storage tank 23, and combustor 24, as discussed below, provide the rotary vane motor 26 with pressurized gas that drives rotary vane motor 26.

The compressor 22 provides compressed air to the air storage tank 23. The direction of flow of the compressed air, and the high-temperature, pressurized gas subsequently produced in the combustor 24 when the air is mixed with fuel and burned, are denoted in the figures by the reference character "F."

The compressor 22 can be, for example, a piston and cylinder compressor; a lobe compressor; a sliding vane compressor; a Wankel-type rotor or rotary screw compressor; or any other type of compressor suitable for providing compressed air to the combustor 24. The compressor 22 can be driven, for example, by a separate electric motor, gears from the expander output shaft, or other suitable means.

An exhaust source 28, designated in phantom in FIG. 1, can be used in lieu of the compressor 22 as the source of compressed air in alternative embodiments. The exhaust source 28 can be, for example, a diesel, Otto, or other type of internal combustion engine.

The compression ratio of the compressor 22 is within the range of approximately 10:1. This particular range of compression ratios is specified for exemplary purposes only; the optimal compression ratio or range or compression ratios is dependent upon the requirements of the rotary vane motor 26, which in turn can vary with factors such as the required torque for the rotary vane motor 26 in a particular application.

The compressor 22 can be formed from one or more self-lubricating materials such as a carbide, nitride or boride; or an oxide of a material such as aluminum, silicon, titanium, vanadium, tungsten, or zirconium. The compressor 22 can be formed from materials other than self-lubricating materials in alternative embodiments.

The combustor 24 has a combustion chamber 30, shown in FIG. 1. The compressed air from the air storage tank 23 (or the exhaust source 28) flows to the combustion chamber 30, as denoted in FIG. 1.

The engine system 10 can also include a fuel source 32 in fluid communication with the combustion chamber 30, and an ignition source or igniter 34 located in or proximate the combustion chamber 30, as shown in FIG. 1. The fuel provided by the fuel source 32 can be virtually any type of fuel that, when mixed with the compressed air in the combustion chamber 30 and burned, releases sufficient energy to drive the rotary vane motor 26. For example, the fuel can be automotive gasoline. Alternatively, exhaust from the exhaust source 28 can be directed to the combustion chamber 30, along with additional air and a catalyst to complete combustion of the exhaust products.

The mixture of air and combustion products produced in the combustion chamber 30 is hereinafter referred to as "the working fluid."

The air storage tank 23 provides a reserve of compressed air that can help ensure that the combustor 24 is adequately supplied with air during periods of peak demand, such as when the rotary vane motor 26 is accelerating. Alternative embodiments can be configured without the air storage tank 23, i.e., the compressor 22 can provide compressed air directly to the combustor 24 in alternative embodiments.

Figure 2:
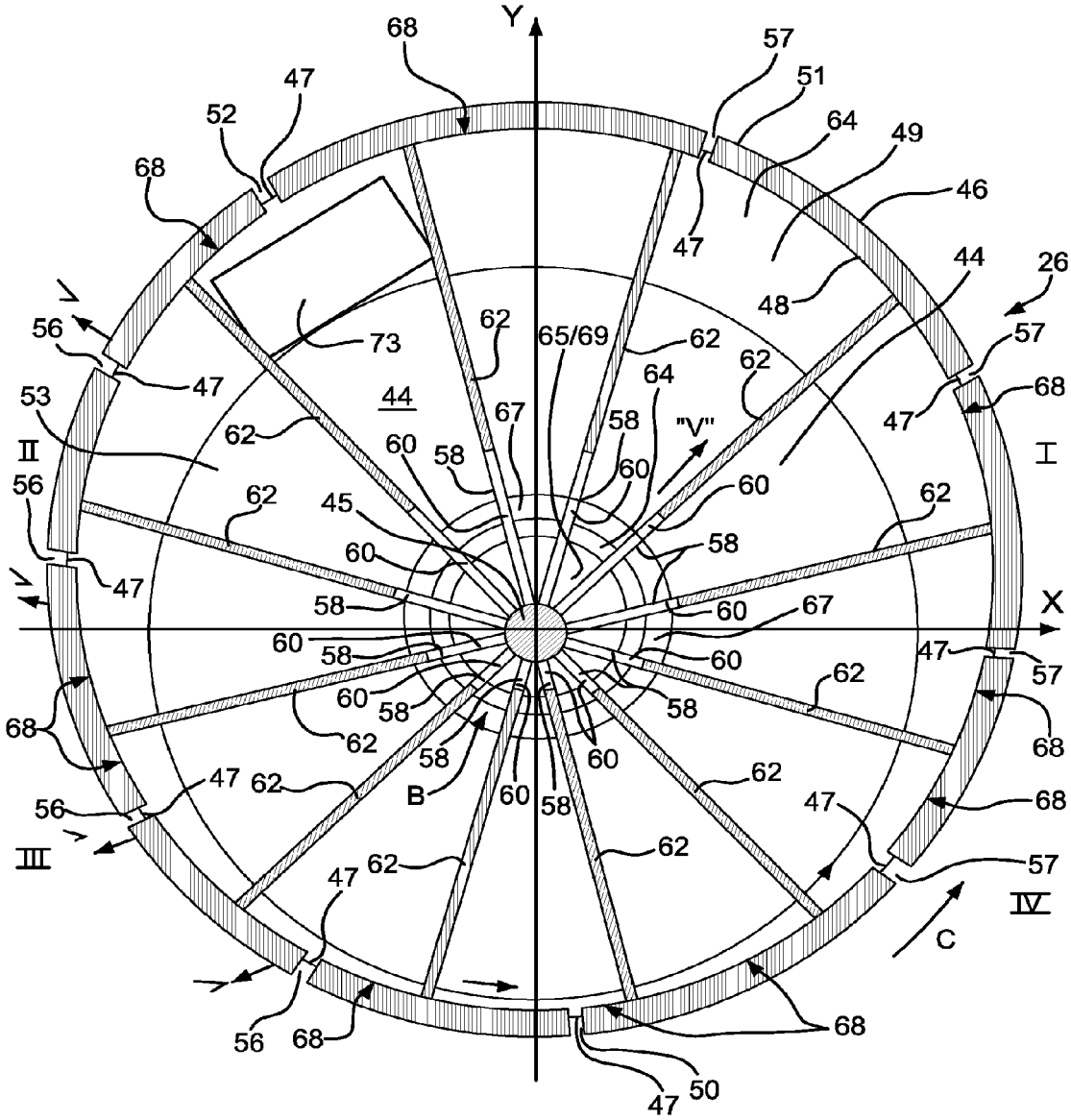
FIG. 2 is a front view of a rotary vane engine of the engine system shown in FIG. 1, with a front cover of the rotary vane engine removed for clarity of illustration.
Figure 3:
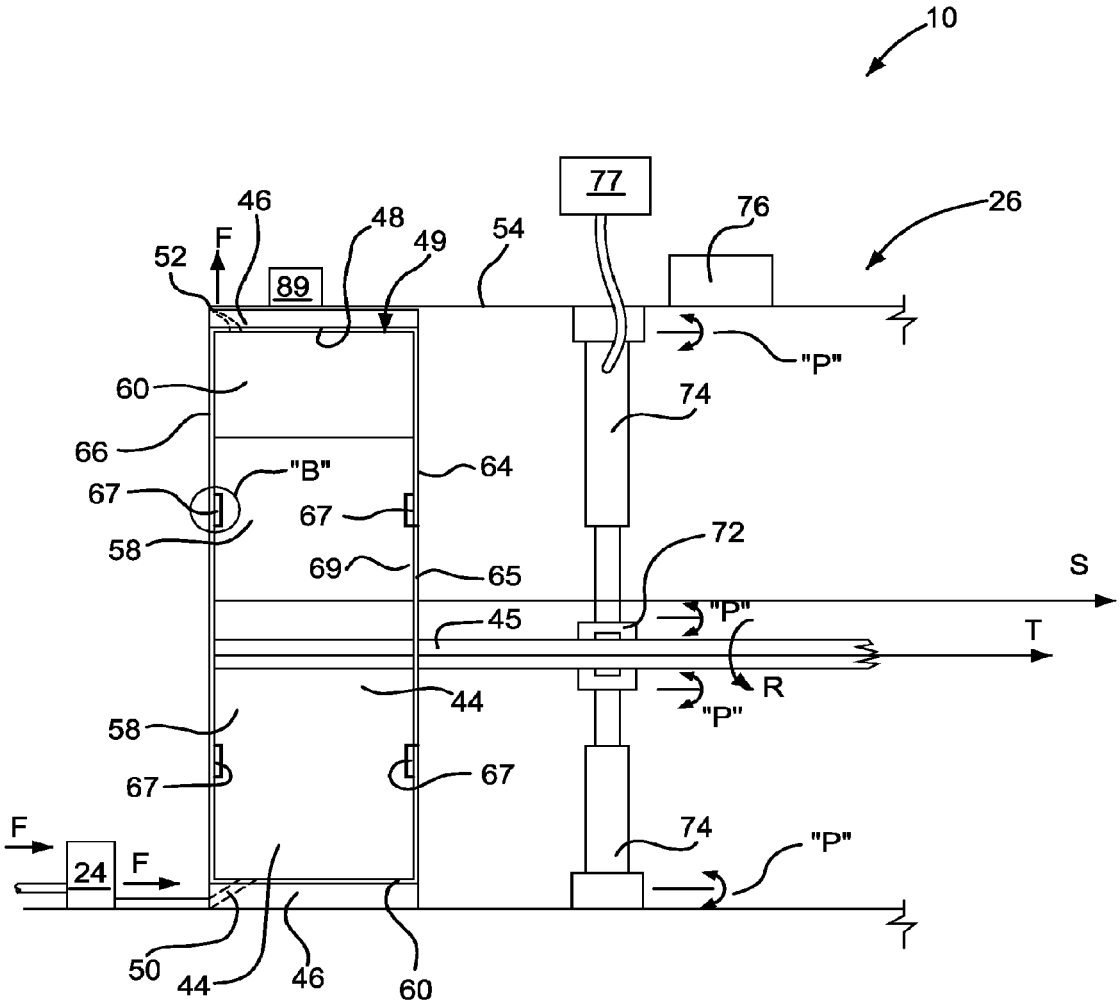
FIG. 3 is a longitudinal cross-sectional view of the rotary vane engine shown in FIGS. 1 and 2.

The rotary vane motor 26 comprises an outer casing 54, and a housing 46 mounted within the outer casing 54 as shown in FIGS. 2 and 3. The housing 46 has an interior surface 48 that defines a substantially cylindrical chamber 49 in the housing 46, as shown in FIGS. 2 and 3.

The housing 46 has an inlet 50 formed therein, as shown in FIGS. 2 and 3. The inlet 50 is in fluid communication with the combustor 24. The working fluid from the combustor 24 flows into the housing 46 in a compressed, i.e., unexpanded, state by way of the inlet 50.

The housing 46 also has an outlet 52 formed therein. The working fluid exits the housing 46 by way of the outlet 52 after being expanded as discussed below.

The outlet 52 is offset from the inlet 50 so that the outlet 52 and the inlet 50 are spaced apart circumferentially by more than 180°, as shown in FIG. 2. This feature can help to extend the dwell time of the working fluid within the rotary vane motor 26, which in turn can help to ensure that the pressure and temperature of the working fluid are close to the ambient pressure and temperature when the working fluid exits the rotary vane motor 26. The inlet 50 and the outlet 52 can be spaced apart circumferentially by 180° or less in alternative embodiments. The optimal spacing is dependent upon factors such as the overall number of vanes 62 in the rotor 44, the circumference or diameter of the housing 46, and the desired operating characteristics in a particular application.

The inventor has found that the optimal, i.e., maximum, sealing between the tips of the vanes 58 and the interior surface 48 of the housing 46 occurs when the vanes are proximate the six o'clock position, from the perspective of FIG. 2, due to the effect of gravity as the vanes 58 rotate toward and through the six o'clock position. It is therefore preferable (but not mandatory) to position the inlet 50 at or near the six o'clock position as shown in FIG. 2.

A plurality of vent openings 56 can be formed in the left side of the housing 46 (from the perspective or FIG. 2), between the inlet 50 and the outlet 52. A plurality of ports 57 can be formed in the right side of the housing 46, between the inlet 50 and the outlet 52. The respective functions of the vent openings 56 and the ports 57 are discussed below.

The rotary vane motor 26 also comprises a rotor 44 positioned in the chamber 49 within the housing 46, as shown in FIGS. 2 and 3. The rotary vane motor 26 also includes a shaft 45, and a bearing 72 shown in FIG. 3. The shaft 45 has a longitudinal axis denoted by the reference character "T" in FIG. 3. The shaft 45 is mounted on the bearing 72 so that the shaft 45 can rotate in relation to the housing 46 and the outer casing 54.

The rotor 44 is mounted on the shaft 45, so that the rotor 44 rotates within the chamber 49 about the longitudinal axis T. The rotor 44 can be connected to a load 27, depicted in FIG. 1, so that the rotor 44 provides a torque to the load 27. The load 27 can be, for example, an electrical generator, a transmission of a motor vehicle, a pump, or other type of machine configured to receive a torque input.

Figure 4:
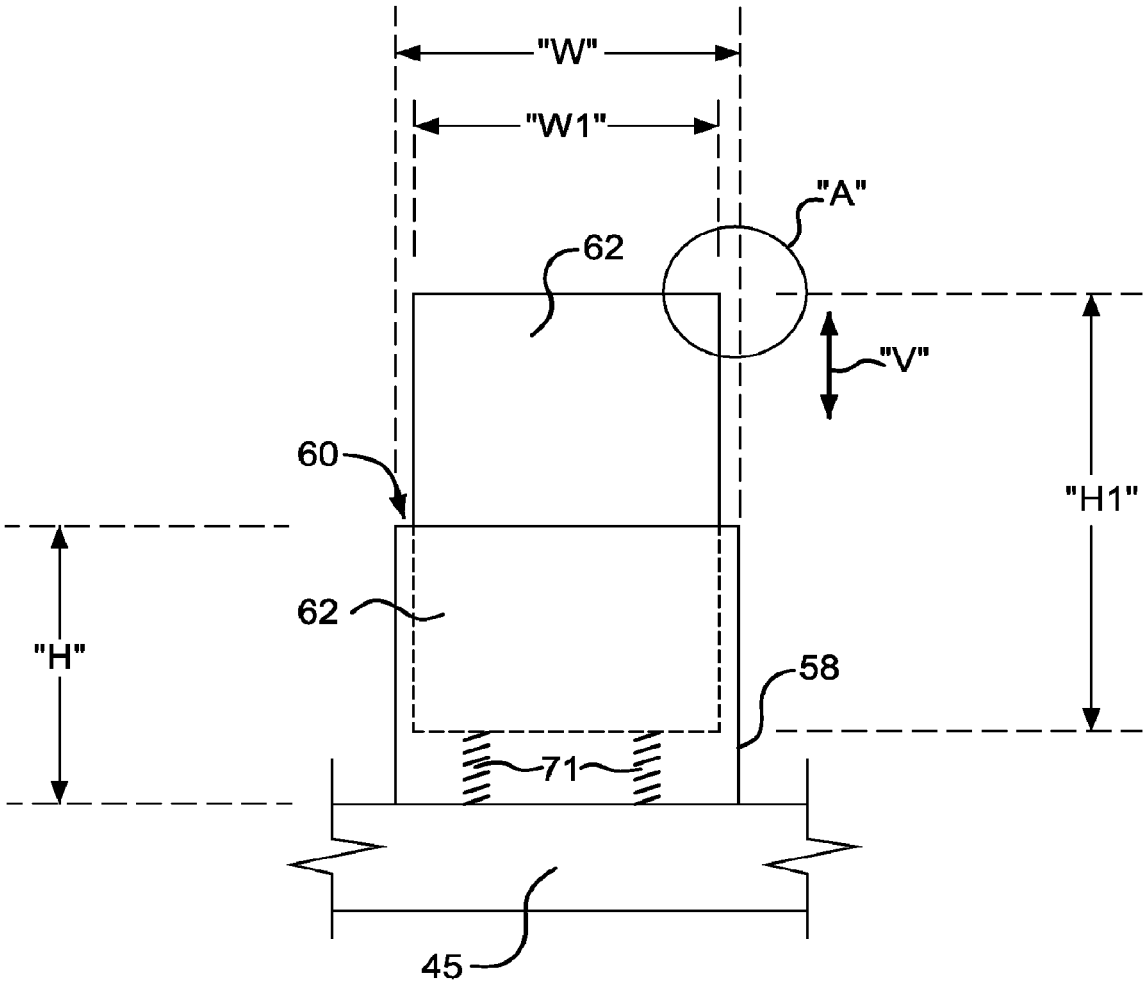
FIG. 4 is a side view of a vane, a vane guide, and a portion of a shaft of the rotary vane engine shown in FIGS. 1-3.

The rotor 44 comprises a plurality of radially-oriented vane guides 58 that extend in a direction substantially perpendicular to the longitudinal axis T of the shaft 45, as shown in FIGS. 2-4. The vane guides 58 are each mounted on the shaft 45 by a suitable means such as welding or casting, so that the vane guides 58 extend radially outward from the shaft 45 as shown in FIG. 2. Each vane guide 58 defines a vane slot 60.

The rotor 44 further comprises a plurality of vanes 62. Each vane 62 is positioned within a vane slot 60 of an associated one of the vane guides 58. The vanes 62 and the vane guides 58 each have a substantially rectangular shape. The vanes 62 and the vane guides 58 can have a shape other than rectangular in alternative embodiments.

The rotor 44 is depicted with twelve of the vanes 62 and twelve of the vane guides 58 for exemplary purposes only. Alternative embodiments can include more, or less than twelve vanes 62 and twelve vane guides 58. The optimal number of vanes 62 and vane guides 58 is application-dependent, and can vary with factors such as cost limitations, the desired efficiency and torque output of the rotary vane motor 26, etc.

Each vane slot 60 has a width, denoted by the reference character "W" in FIG. 4. Each vane 62 has a width, denoted by the reference character "W1" in FIG. 4. The width W of the vane slots 60 is slightly greater than the width W1 of the vanes 62. This feature permits each vane 62 to slide within its associated vane slot 60 in a direction substantially perpendicular to the shaft axis T. The direction of movement of the vanes 62 in relation to the vane slots 60 is denoted by the arrow "V" in FIGS. 2 and 4. The clearance between the vane guides 58 and the vanes 62 can be, for example, 0.001 inch. A specific value for the clearance is specified for exemplary purposes only. The optimal clearance is application-dependent, and can vary with factors such as the thermal expansion characteristics of materials from which the vane guides 58 and the vanes 62 are formed.

Each vane guide 58 has a height, or radial dimension, denoted by the reference character "H" in FIG. 4. Each vane 62 has a height, denoted by the reference character "H1" in FIG. 4. The height H of the vane guides 58 is less than the height H1 of the vanes 62. This feature permits a portion of each vane 62 to slide into and out of its associated vane guide 58 during rotation of the rotor 44, while the vane guide 58 continues to retain the vane 62.

Figure 5:
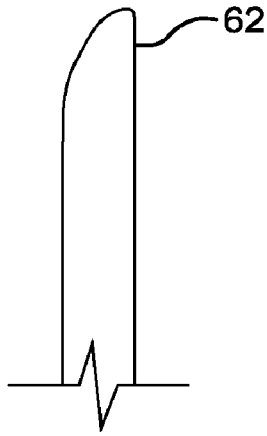
FIG. 5 is a magnified view of the area designated "A" in FIG. 4, viewed from a perspective rotated approximately ninety degrees from the perspective of FIG. 4.

The tip of each vane 62 can be rounded as depicted in FIG. 5. This feature is believed to help reduce wear of the vane 62 as the vane 62 rubs against the interior surface 48 of the housing 46 during operation of the rotary vane engine 26.

The rotary vane motor 26 also comprises a first end plate or cover 64, as shown in FIG. 3. The rotary vane motor 26 further comprises a second end plate or cover 66, also shown in FIG. 3. The first and second covers 64, 66 are mounted on opposite ends of the housing 46, using a suitable means such as fasteners. The rotary vane engine 26 is depicted in FIG. 2 with the second cover 66 removed, for clarity of illustration.

The housing 46 and one or both of the first and second covers 64, 66 can be unitarily formed in alternative embodiments. The first cover 64 and/or the second cover 66 can have vent openings (not shown) formed therein in addition to, or in lieu of the vent openings 56 in the housing 46.

The first cover 64 has an opening 65 formed therein, as shown in FIGS. 2 and 3. The shaft 45 extends through the opening 65. The shaft 45 can be moved in a direction substantially perpendicular to the shaft axis T, as discussed below. The opening 65 has a diameter that is sufficient to prevent interference between the shaft 45 and the first cover 64 during the transverse movement of the shaft 45.

The rotary vane motor 26 also comprises a ring 67, as shown in FIG. 3. The ring 67 is positioned between the first cover 64 and the rotor 44 proximate the inner circumference of the first cover 64, as shown in FIG. 3. The ring 67 forms a seal between the first cover 64 and the rearward edges of the vane guides 58. The ring 67 can be mounted on the cover 64 by a suitable means such as fasteners.

The ring 67 has an opening 69 formed therein, as shown in FIGS. 2 and 3. The opening 69 has a diameter that is sufficient to prevent interference between the shaft 45 and the ring 67 during the transverse movement of the shaft 45. The ring 67 can be formed from a material suitable for forming a seal between the first cover 64 and the rotor 44. For example, the ring 67 can be formed from a graphite composite material.

Another ring 67 can be positioned between the rotor 44 and the second cover 66 as shown in FIG. 3, to provide a seal between the second cover 66 and the forward edges of the vane guides 58.

Figure 8:
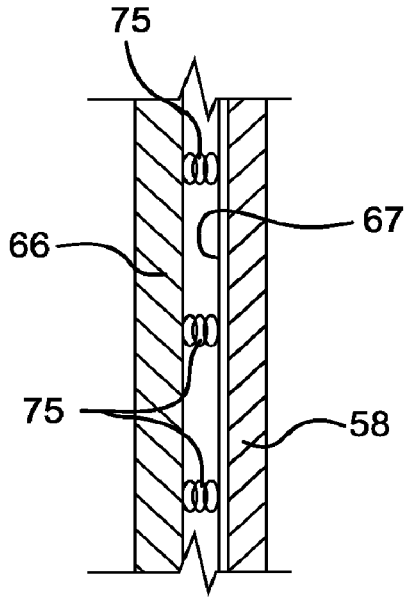
FIG. 8 is a magnified view corresponding to the area designated "B" in FIG. 4, depicting an alternative embodiment of the rotary vane engine shown in FIGS. 1-7.

Other types of suitable seals, such as labyrinth seals, can be used in lieu of the rings 67 in alternative embodiments. Moreover, the rings 67 can be mounted on springs 75 in alternative embodiments, as shown in FIG. 8. The springs 75, in turn, can be mounted on the first or second covers 64, 66. This feature can help to maintain the seal between the rings 67 and the associated forward or rearward edges of the vane guides 58 and the vanes 62 as the rings experience normal wear over the life of the rotary vane motor 26.

A plurality of radially-oriented chambers 68 are formed within the rotary vane motor 26, as shown in FIG. 2. Each chamber 68 is defined by the interior surface 48 of the housing 46, two adjacent vanes 62 and their corresponding vane guides 58, and the rings 67.

The rotor 44 rotates in a counterclockwise direction from the perspective of FIG. 2, as denoted by the arrow "C" in FIG. 2. FIG. 2 depicts the rotor 44 during operation at or near its normal operational speed. A centrifugal force is imposed on each vane 62 due to rotation of the rotor 44. The centrifugal forces cause the vanes 62 to slide outwardly, so that an outermost portion of each vane 62 is forced outside of its associated vane guide 58, and the outer edge of the each vane 62 contacts the interior surface 48 of the housing 46. The outer edges of the vanes 62 can thus rub against the interior surface 48 of the housing 46 during rotation of the rotor 44, as depicted in FIG. 2. The outwardly-acting centrifugal force can be augmented by a suitable biasing means such as springs 71 depicted in FIG. 4, compressed gas, or other suitable means, to help facilitate effective sealing between the outer edges of the vanes 62 and the interior surface 48.

A barrier 47 can be positioned within each of the inlet 50 and the outlet 52 to prevent the vanes 62 from sliding out of the housing 46 as the vanes 62 rotate past the inlet 50 and the outlet 52, as shown in FIG. 2. The barriers 47 can be, for example, screens or other suitable means that retain the vanes 62 while allowing the working fluid to flow therethrough. Additional barriers 47 can likewise be positioned within each of the vent openings 56 and each of the ports 57, to prevent the vanes 62 from sliding out of the housing 46 as the vanes 62 rotate past the vent openings 56 and the ports 57.

The shaft 45 can be positioned so that its axis T is offset from a central axis "S" of the housing 46, as shown in FIGS. 2 and 3. The vanes 62 are thus forced outwardly as the vanes 62 approach the outlet 52, due to the centrifugal forces acting on the vanes 62, in conjunction with the increasing spacing between the shaft 45 and the interior surface 48 of the housing 46 as the vanes 62 approach the outlet 52. Conversely, the vanes 62 are forced inwardly as the vanes approach the inlet 50, due to the decreasing spacing between the shaft 45 and the interior surface 48 as the vanes 62 approach the inlet 50.

The rotor 44 rotates in response to the expansion of the working fluid in the chambers 68. In particular, the working fluid enters each chamber 68 via the inlet 50 as the chamber 68 rotates past the inlet 50. As discussed above, the working fluid is in a compressed, i.e., unexpanded, state when it is supplied to the inlet 50 from the combustor 24. Thus, each chamber 68 is filled with a charge of unexpanded working fluid as the chamber 68 rotates past the inlet 50.

The volume of each chamber 68 is at or near its minimum as the chamber 68 rotates past the inlet 50, when the rotor 44 and the housing 46 are in the relative positions depicted in FIG. 2. The pressure of the working fluid within each chamber 68 is thus at a maximum when the chamber 68 is located at or near the inlet 50. When the centerline T of the shaft 45 is offset from the centerline of the housing 46 as shown in FIG. 2, the spacing between the shaft 45 (which defines one end of the chamber 68) and the interior surface 48 of the housing 46 (which defines the other end of the chamber 68) increases as the chamber 68 rotates away from the inlet 50 and toward the outlet 52. The volume of each chamber 68 therefore increases as the chamber 68 approaches the outlet 52. The corresponding expansion of the working fluid within the chamber 68 as the chamber 68 rotates away from the inlet 50 and toward the outlet 52 imparts a rotational force, or torque, to the rotor 45.

Optimally, the working fluid in the chamber 68 has expanded so that its pressure and temperature are close to ambient by the time the chamber 68 reaches the outlet 52. The amount of energy extracted from the working fluid at or near maximum when the working fluid is expanded in this manner.

At least some of the expanded working fluid in each chamber 68 exits the chamber 68 and is exhausted from the housing 46 by way of the outlet 52 as the chamber 68 rotates past the outlet 52. If desired, heat from the exhaust can be exchanged with the compressed air entering the combustor 24, with the working fluid entering the rotary vane motor 26 from combustor 24, or with the working fluid at other stages within the cycle, to help optimize the thermal efficiency of the engine system 10.

The vanes 62 surrounding each chamber 68 are forced inward, into their corresponding vane guides 58, as the chamber 68 rotates between the outlet 52 and the inlet 50 due to the decreasing spacing between the shaft 45 and the interior surface 48 of the housing 46. The volume of the chambers 68 thus decreases as the chambers 68 approach the inlet 50.

Each chamber 68 passes the vent openings 56 as the chamber 68 rotates away from the outlet 52 and toward the inlet 50. The vent openings 56 help to control the pressure within the chambers 48 as the chambers 48 approach the inlet 50. In particular, the vent openings 56 permit residual working fluid in the chamber 68 to escape from the chamber 68 as the volume of the chamber 68 is reduced. Venting the chamber 68 in this manner prevents the residual working fluid within the chamber 68 from being compressed to levels that could prevent the unexpanded working fluid supplied by the combustor 24 from entering the chamber 68 when the chamber 68 reaches the inlet 52.

Figure 6:
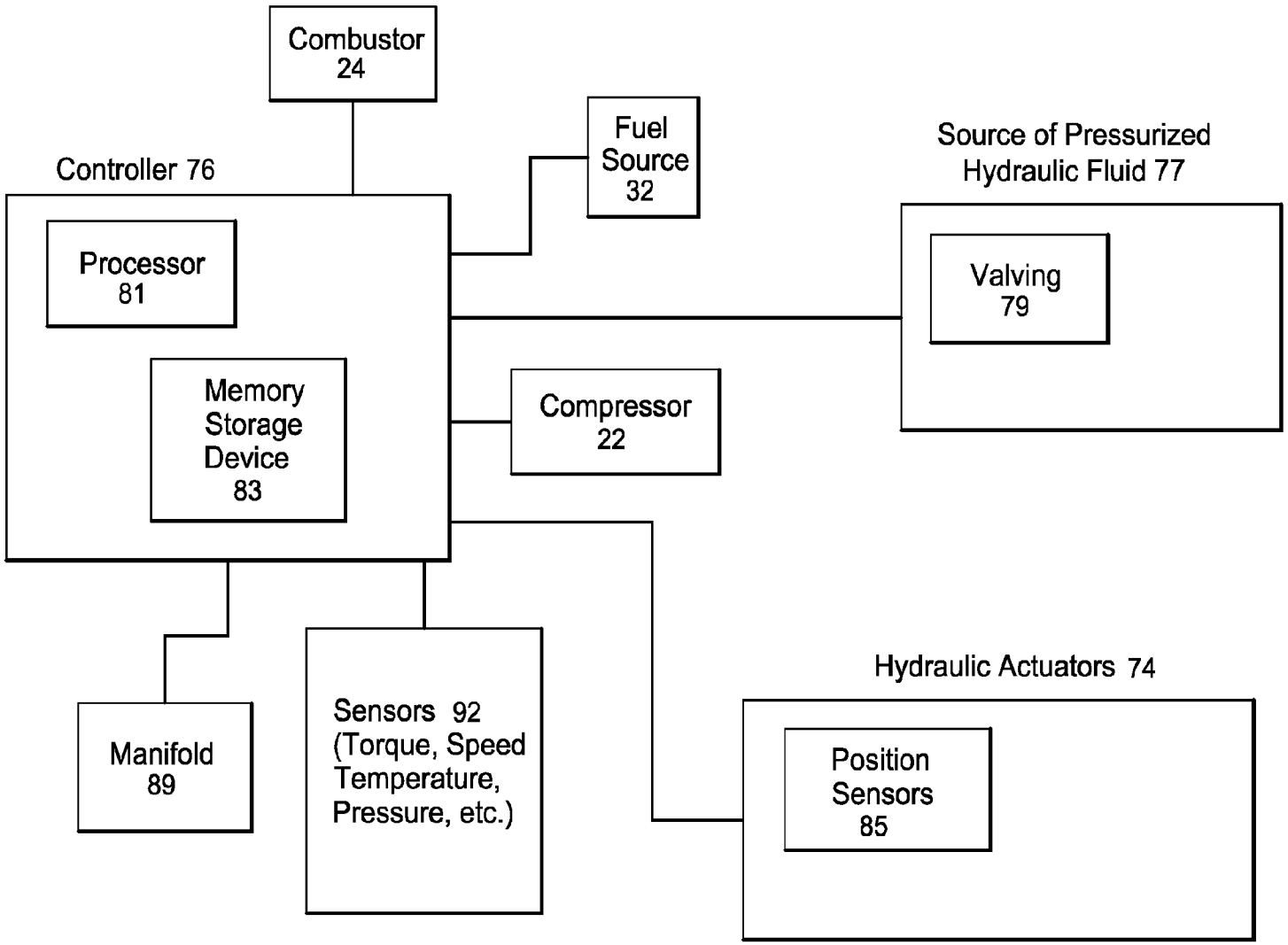
FIG. 6 is a diagrammatic depiction of various electrical, electronic, and electro-mechanical components of the engine system shown in FIGS. 1-4.
Figure 7:
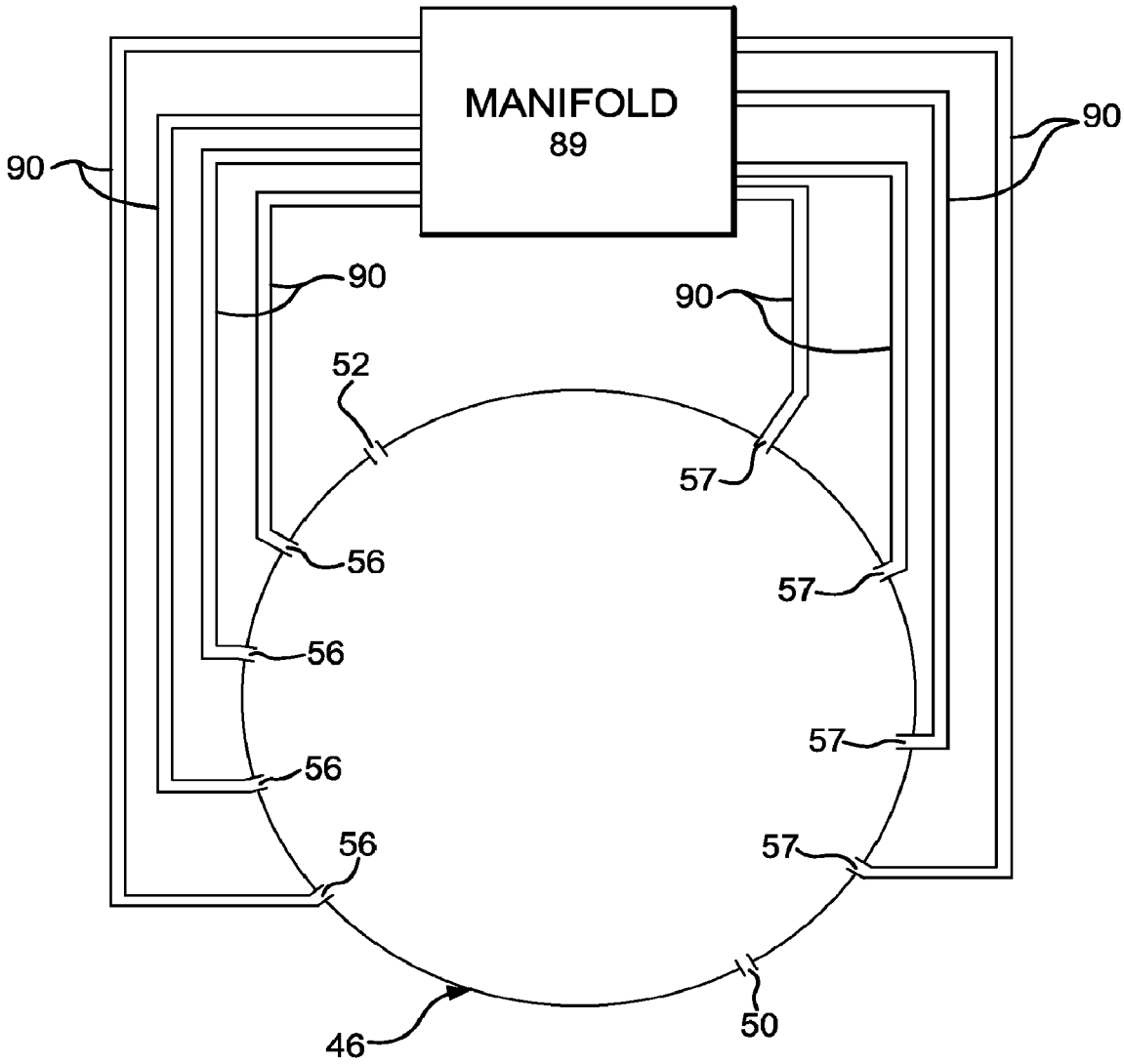
FIG. 7 is a diagrammatic depiction of a manifold and piping used to route gases within the rotary vane engine shown in FIGS. 1-4.

The partially-compressed working fluid vented by way of the vent openings 56 can be directed to one or more of the ports 57, and introduced into the chambers 68 in which the expansion portion of the cycle is occurring. In particular, the motor system 10 can include a manifold 89, shown in FIGS. 6 and 7. The manifold 89 can be in fluid communication with the vent openings 56 and the ports 57 by way of piping 90, as shown diagrammatically in FIG. 7. In addition, the manifold 89 is communicatively coupled to the controller 79, as shown in FIG. 7.

The controller 76 can be programmed to provide control inputs to the manifold 89 that cause the manifold 89 to port the residual working fluid vented through the vent openings 56 to an appropriate one of the ports 67. The residual working fluid vented via a particular vent opening 56 can be routed to a port 57 that will direct the working fluid into a chamber 68 containing unexpanded or partially expanded working fluid at a similar pressure. The vented working fluid, once being introduced into the chamber 68 by way of the appropriate port 57, can be expanded along with the working fluid already in the chamber 68. At least some of the energy expended in compressing the vented working fluid can thereby be recovered and used in the cycle.

The housing 46 is depicted with four of the ports 57 for exemplary purposes only. Alternative embodiments can include more, or less than four ports 57.

The working fluid vented from the chambers 48 by way of the vent openings 56 can be vented directly to the ambient environment in alternative embodiments, without the use of manifold 89. In other alternative embodiments, some or all of the vented working fluid can be directed to accessories or other components, such as air-actuated shock absorbers and springs, tire inflation means, power trunk lifters, ash removal means for filters, that require a source of pressurized gas, using the manifold 89 or another suitable means for controlling the flow of the residual working fluid.

The spacing between the inlet 50 and the adjacent vent opening 56 is sufficient to ensure that the chambers 48 are not exposed to both the inlet 50 and the adjacent vent opening 56 at the same time. This feature helps to ensure that the chamber 68 is not vented as it is being filled with the unexpanded working fluid from the combustor 24.

The housing 46 is depicted with four of the vent openings 56 for exemplary purposes only. Alternative embodiments can include more, or less than four vent openings 56.

Upon reaching the inlet 50, each chamber 68 is filled with another charge of unexpanded working fluid and the above-noted cycle is repeated during the subsequent revolution of the rotor 44. The continuous stream of working fluid supplied to the chambers 68 as the chambers 68 pass the inlet 50, and the subsequent expansion thereof, cause the rotor 44 and the attached shaft 45 to rotate on a continuous basis, in the direction denoted by the arrow "R" in FIG. 3.

The rotary vane engine 26 can be used as the source of compressed air for the system 10 in alternative embodiments, thereby alleviating the need for the compressor 22. To facilitate this use, an opening 73 can be formed in each of the first and second covers 64, 66 proximate the outer peripheries thereof, as shown in FIG. 2. Fresh, i.e., non-combusted, air can be blown or otherwise directed into each chamber 68 as the chamber 68 rotates past the opening 73 in the second cover 66. The fresh air entering the chamber 68 can displace the combustion products present in the chamber 68 so that the combustion products exit the chamber 68 by way of the opening 73 in the first cover 67. The fresh air can subsequently be compressed as the chamber 68 rotates toward the vent openings 56. The compressed air can be routed to the inlet of the combustor 24 by way of one or more of the vent openings 56. The particular vent opening or openings 56 through which the compressed air is routed is dependent upon the desired pressure of the air entering the combustor 24.

Figure 9:
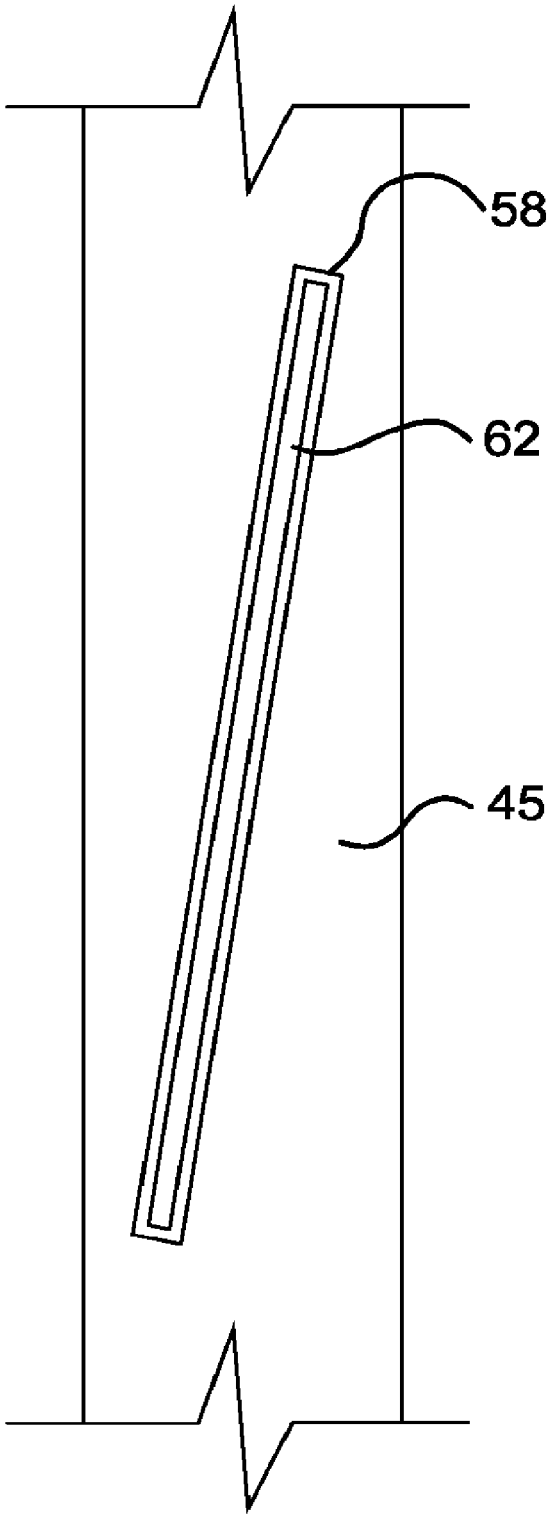
FIG. 9 is a plan view of a rotor of an alternative embodiment of the rotary vane engine shown in FIGS. 1-7, depicting only on one vane and one vane guide of the rotor.

The vane guides 58 and the vanes 62 can be angled in their respective lengthwise directions in relation to the centerline of the shaft 45 in alternative embodiments, as shown in FIG. 9 (only one vane 62 and one vane guide 58 are depicted in FIG. 9, for clarity of illustration). This feature can help the rotor 44 to sweep the working fluid out through the opening 73 in the second cover 66, and fresh air in through the opening 73 in the first cover 64. In other alternative embodiments, the rotor 44 can be equipped with a mechanism that permits the vane guides 58 to be rotated in relation to the centerline of the shaft 45, so that the angle between the centerline of the shaft 45 and the vane guides 58 and vanes 62 can be varied during operation of the rotary vane motor 26.

The housing 46 and the rotor 44 can be made from one or more self-lubricating materials such as a carbide, carbo-nitride, nitride, or boride; or an oxide of a material such as aluminum, silicon, titanium, vanadium, tungsten, or zirconium. A diamond coating or other suitable coating can be applied to the housing 46 and/or rotor 44, if desired. The use of self-lubricating materials can eliminate the need for oils, greases, or other lubricants. Such lubricants can present a slip and fall hazard, and can necessitate periodic clean-up. Moreover, lubricants typically require some type of cooling to prevent thermally-induced degradation. The use of lubricants can thus necessitate the use of cooling means such as a radiator or cooling fins. Moreover, the thermal energy transferred out of the rotary vane motor 26 by the cooling means represents an energy loss that lowers the overall thermal efficiency of the engine system 10. Hence, eliminating the need for lubricants through the use of self-lubricating materials can provide certain advantages.

The housing 46 and the rotor 44 can be formed from materials other than self-lubricating materials in alternative embodiments. For example, the housing 46 and the rotor 44 can be formed from non-self-lubricating materials treated with a lubricating compound such as NEVER-SEEZE®. Other alternative embodiments can be equipped with a lubrication system.

The shaft 45 can be moved in a direction substantially perpendicular to the shaft axis T, as discussed above. In particular, the rotary vane motor 26 comprises four hydraulic actuators 74 that support and constrain the bearing 72 and the shaft 45. Two of the hydraulic actuators 74 are visible in FIG. 3. An outer race of the bearing 72 is connected to a first end of each hydraulic actuator 74 by a pin or other suitable means that permits the hydraulic actuator 74 to pivot in relation to the outer casing 54, about an axis that is substantially parallel to the central axis "S" of the housing 46. The pivotal movement of the hydraulic actuators 74 is denoted by the arrows "P" in FIG. 3.

A second end of each hydraulic actuator 74 is connected to the outer casing 54 by a pin or other suitable means that permits the hydraulic actuator 74 to pivot in relation to the outer casing 54, about an axis that is substantially parallel to the central axis "S" of the housing 46.

The noted mounting arrangement of the shaft 45 facilitates movement of the shaft 45 and the attached rotor 44 in directions substantially perpendicular to the central axis "S" of the housing 46. In particular, the shaft axis T, which is the axis of rotation of the rotor 44, can be moved into, and within each of four quadrants within the housing 46 designated I, II, III, and IV in FIG. 2.

The hydraulic actuators 74 can be mechanically coupled to the bearing 72 and the outer casing 54 by a means other than stationary pins in alternative embodiments. For example, alternative embodiments can be equipped with races. Each race can receive a corresponding pin mounted on the first or second end of the hydraulic actuators 74. The pins can move back and forth within the races to facilitate movement of the hydraulic actuators 74 in relation to the outer casing 54 and the bearing 72.

The position of the rotor 44 in relation to the central axis S of the housing 46 affects the volume of the chambers 68 at a given circumferential, or clock position as the chambers 68 rotate about the shaft axis T. The volume of chambers 68 at a given clock position affects the expansion ratio of the working fluid within rotary vane motor 26, which in turn can influence the operating characteristics, e.g., thermal efficiency, torque output, etc., of the engine system 10.

For example, moving the shaft axis T downward from its centered position, as depicted in FIG. 2, provides the smallest chamber volume at the inlet and the largest chamber volume at the outlet, which provides a relatively high expansion ratio, e.g., 70:1 or greater. The relatively high expansion ratio, in turn maximizes fuel efficiency under load.

Moving the shaft axis T into quadrant II from a position substantially coincident with the central axis S of the housing 46 will generally maximize the torque output of the rotary vane motor.

The shaft axis T can be moved into quadrant IV when it is desired to maximize the amount, i.e., the flow-rate, of pressurized air that can be extracted from the rotary vane motor 26 via the vent openings 56.

The shaft axis T can be moved into quadrant III when the rotary vane motor 26 is idling, to minimize fuel consumption during idle, i.e., no load, operation.

The engine system 10 can also include a source of pressurized hydraulic fluid 77 in fluid communication with the head and rod ends of each hydraulic actuator 74, as shown in FIGS. 3 and 5. The source of pressurized hydraulic fluid 77 is depicted in FIG. 3 as being in fluid communication with only the head end of one of the hydraulic actuators 74, for clarity of illustration.

The source of pressurized hydraulic fluid 77 includes valving 79 that selectively directs the pressurized hydraulic fluid to the head and rod ends of each hydraulic actuator 74, to effectuate extension and retraction of the hydraulic actuator 74. The valving 79 is depicted diagrammatically in FIG. 6. The extension and retraction of the hydraulic actuators 74 is coordinated so as to cause movement of the rotor 44 in a direction substantially perpendicular to the axis T of the shaft 45, which alters the position of the shaft axis T in relation to the central axis S of the housing 46.

The engine system 10 can further include a controller 76, depicted in FIGS. 3 and 5. The controller 76 comprises a processor 81. The processor 81 can be, for example, a microprocessor or other suitable computing device. The controller 76 can also comprise a memory-storage device 83 communicatively coupled to the processor 81.

The controller 76 is communicatively coupled to the valving 79 of the source of pressurized hydraulic fluid 77. The controller 76 is programmed to control the extension and retraction of the hydraulic actuators 74 in a coordinated manner so as to effectuate movement of the shaft 45 and the rotor 44 in a desired direction into, or within one of the quadrants I, II, III, or IV, to alter the expansion ratio of the rotary vane motor 26.

The controller 76 can receive inputs relating to various operating parameters of the engine system 10, including the position of the shaft 45 and/or the rotor 44, and can control the operation of the engine system 10 based on the inputs. For example, the controller 76 can receive inputs from a torque sensor that provides an indication of the output torque being transmitted by the shaft 45; a speed sensor that provides an indication of the rotational speed of the rotor 44; temperature and pressure sensors that provide indications of the pressure and temperature with one or more of the chambers 68; etc. These sensors are denoted collectively in FIG. 6 using the reference character 92.

The controller 76 can be programmed to function as closed-loop controller that adjusts selected operating parameters, e.g., fuel flow and airflow to the combustor 24, to achieve a desired operating condition, e.g., a desired torque output. The controller 76 can simultaneously control the position of the rotor 44 to achieve an optimal expansion ratio for a particular set of inputs. The use of a closed-loop control methodology is specified for exemplary purposes only; other types of control methodologies can be used in the alternative.

Each hydraulic actuator 74 can be equipped with a position sensor 85 or other means that provides an indication to the controller 76 of the extent to which the hydraulic actuator 74 is extended. The position sensors 85 are depicted in FIG. 6. The controller 76 can use these inputs to determine the position of the rotor 44 in relation to the central axis "S" of the housing 46. The controller 76, as noted above, can be programmed to adjust the position of the rotor 44 based on inputs representing one or more operating parameters of the rotary vane motor 26. The controller 76 can effectuate the position adjustment by providing control inputs to the valving 79 of the source of pressurized hydraulic fluid 77. The control inputs cause the valving 79 to port hydraulic fluid to the head or rod ends of the hydraulic actuators 74 in a coordinated manner so as to effectuate the desired positioning of the rotor 44.

During operation of the engine system 10, the compressor 22 supplies pressurized air to the air-storage tank 23. The pressurized air is directed from the air-storage tank 23 to the combustor, where the air is mixed with fuel and burned continuously to produce a stream of high-pressure, high-temperature working fluid.

The working fluid enters rotary vane motor 26 by way of the inlet 50. A charge of the high-pressure, high-temperature working fluid enters each individual chamber 68 of the rotary vane motor 26 as the chamber 68 rotates past the inlet 50. The vanes 62 associated with chamber 68 may be partially or fully extended from their associated vane guides 58 as the chambers 68 pass the inlet 50, depending on the position of the rotor 44 in relation to the housing 46.

The working fluid, after entering the chamber 68, expands as the chamber subsequently rotates away from the inlet 50, thereby imparting a rotational force to the rotor 44. The rotation of the rotor 44 subjects the vanes 62 that define the chamber 68 to a centrifugal force that urges the vanes 62 in an outward direction, so that the volume of the chamber 68 increases. Moreover, the centrifugal force urges the outer edges of the vanes 62 against the interior surface 48 of the housing 46. Under optimal conditions, the expansion of the working fluid continues until the working fluid has been expanded to a pressure slightly above ambient. The expanded working fluid is exhausted from the chamber 68 as the chamber 68 rotates past the outlet 52.

The vanes 62 may be partially or fully retraced into their associated vane guides 58 as the chamber 68 rotates toward the inlet 50 after passing the outlet 52, depending on the position of the rotor 44 in relation to the housing 46. The volume of the chamber 68 thus decreases as the chamber rotates toward the inlet 50. The housing 46 can have vent openings 56 formed therein, at circumferential locations between the outlet 52 and the inlet 50. Residual working fluid can vent from the chambers 68 by way of the vent openings 56 as the chambers 68 pass the vent openings 56. Venting of the residual working fluid helps to ensure that the pressure in the chamber 68 is low enough when the chamber 68 reaches the inlet 50 to permit a new charge of high-temperature, high-pressure working fluid to enter the chamber 68.

The continuous stream of working fluid supplied to the chambers 68 as the chambers 68 pass the inlet 50, and the subsequent expansion thereof, cause the rotor 44 and the attached shaft 45 to rotate on a continuous basis. The shaft 45 can provide torque to a device, such as an electrical generator or an automotive transmission, connected thereto.

The rotor 44 can be moved in directions substantially perpendicular to the central axis "S" of the housing 46. Moving the rotor 44 in this manner can alter the relationship between the volume and clock position of the chambers 68, which in turn can affect to expansion ratio of the rotary vane motor 26. The expansion ratio can be varied by the controller 76 so as to optimize one or more operating parameters of the rotary vane motor 26 at a given operating condition. Thus, the operation of the rotary vane motor 26 can be optimized over a range of operating conditions. In alternative embodiments in which the rotary vane motor 26 is used to compress the working fluid, the compression ratio can be varied along the with expansion ratio in a manner that optimizes the operation of the rotary vane motor 26.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, can make numerous modifications to the invention as described herein, and changes may be made without departing from the scope and spirit of the invention as defined by the appended claims.

For example, the rotor 44 of the rotary vane motor 26 is cantilevered from a single support point, i.e., the bearing 72. Supporting the rotor 44 in this manner can help to minimize the overall length of the rotary vane motor 26. The rotor 44 can be supported in other ways in alternative embodiments. For example, the shaft 45 can be lengthened so as to extend forwardly through the second cover 66, and a second bearing 72 can be added so that the rotor 44 is suspended between the two bearings 72. If desired, the forward portion of the lengthened shaft 45 can be connected to an auxiliary load, such as an alternator or pump of a motor vehicle. Supporting the shaft 45 from two or more points can allow the shaft 45 and the bearings 72 to be made smaller and lighter in relation to embodiments in which the shaft 45 is cantilevered from a single support point.

The rotary vane motor 26 is depicted with four of the hydraulic actuators 74 for exemplary purposes only. Alternative embodiments can be configured with more, or less than four hydraulic actuators 74. For example, alternative embodiments can include two hydraulic actuators 74 positioned in an opposing relationship. This arrangement can facilitate movement of the rotor 44 in a single linear direction. For example, the two actuators 74 can be oriented vertically from the perspective of FIG. 2, to facilitate up-down movement of the rotor 44. Alternatively, the actuators 74 can be oriented horizontally, to facilitate side-to-side movement of the rotor 44; or diagonally, to facilitate movement having both up-down and side-to-side components.

Other alternative embodiments can use screw jacks, pneumatic cylinders, cams, ramps, lobes, or other suitable actuation means in lieu of the hydraulic actuators 74. Moreover, the hydraulic actuators 74 or other actuation means can be located outside of the outer casing 54 in other alternative embodiments.

Figure 10:
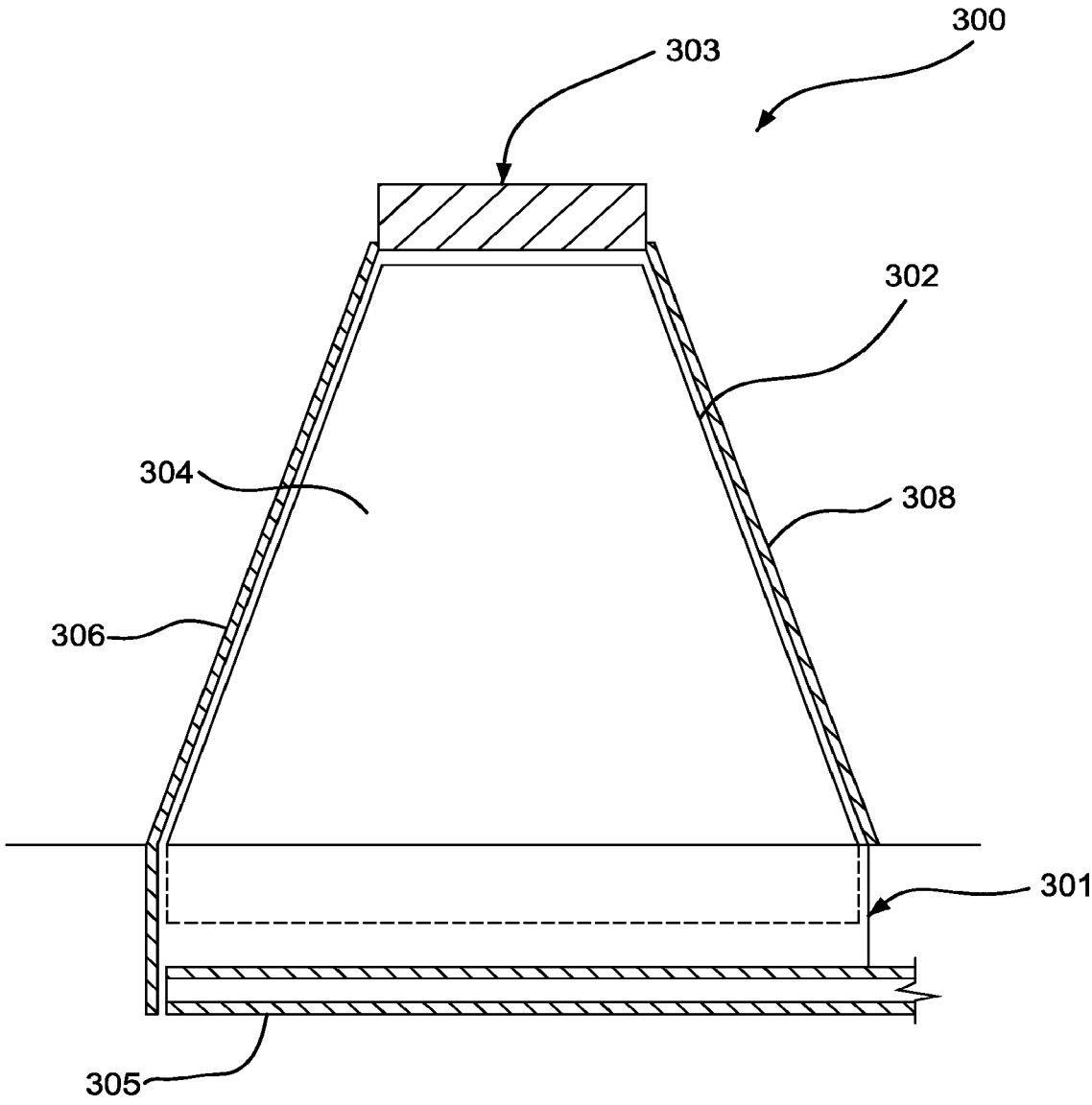
FIG. 10 is a cross-sectional view of an upper half of another alternative embodiment of the rotary vane engine shown in FIGS. 1-7.

FIG. 10 depicts an alternative embodiment having features that help to maintain the seal between the vanes and the adjacent surfaces of the front and rear covers and the outer casing as the vane experiences wear. In particular, FIG. 10 depicts an alternative embodiment in the form of a rotary vane motor 300. The motor 300 comprises a plurality of vane guides 301, a plurality of vanes 302 each partially disposed in an associated vane guide 301, a housing 303, and a rotatable shaft 305 on which the vanes 302 and the vane guides 301 are mounted (only one vane 302 and one vane guide 301 are visible in FIG. 10). Each vane 302 has an upper portion 304 shaped substantially as a trapezoid. The motor 300 also includes a front cover 306 and a rear cover 308 each secured to the housing 303. The front and rear covers 306, 308 are angled in relation to the vertical direction, so that the orientation of the front and rear covers 306, 308 substantially matches the orientation of the forward and rearward edges of the upper portions of the vanes 302 as shown in FIG. 10. The geometry of the vanes 302 and the front and rear covers 306, 308 permits the forward, rearward, and outer edges of each vane 302 to remain in contact with the adjacent surfaces of the respective front cover 306, rear cover 308, and housing 303 due to centrifugal force as the vane 302 and the adjacent surfaces wear, thereby maintaining a seal between the vane 302 and the adjacent surfaces. The forward, rearward, and outer edges of the vane 302 are depicted in FIG. 10 as spaced apart from the adjacent surfaces of the respective front cover 306, rear cover 308, and housing 303 for clarity of illustration.

The vanes 302 and/or the front cover 306, rear cover 308, and housing 303 (or the contacting surfaces thereof) can be formed from a self-lubricating material such as silicon carbide. Alternatively, the vanes 302 and/or the front cover 306, rear cover 308, and housing 303 can be formed from a relatively inexpensive material such as steel, and a suitable lubricant such as NEVER-SEEZE® can be sprayed onto the contacting surfaces of the vanes 302, the front and rear covers 306, 308, and the housing 303 on an intermittent basis during operation of the motor 300.

Figure 11:
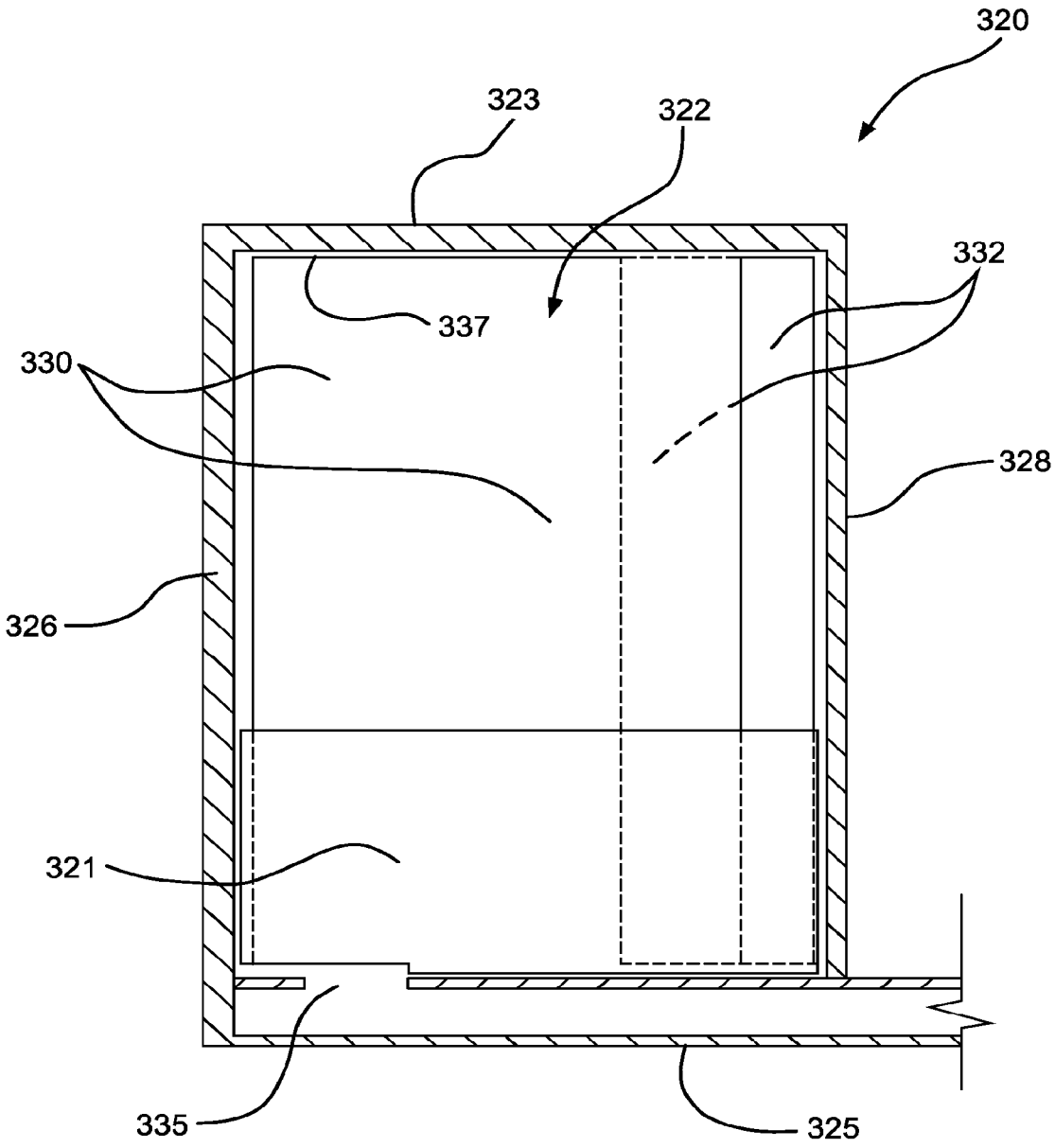
FIG. 11 is a cross-sectional view of an upper half of another alternative embodiment of the rotary vane engine shown in FIGS. 1-7.

FIG. 11 depicts an alternative embodiment having features that help to maintain the seal between the vanes and the adjacent surfaces of the front and rear covers. In particular, FIG. 11 depicts an alternative embodiment in the form of a rotary vane motor 320. The motor 320 comprises a plurality of vane guides 321, a plurality of vanes 322 each partially disposed in an associated vane guide 321, a housing 323, and a rotatable shaft 325 on which the vanes 322 and the vane guides 321 are mounted (only one vane 322 and one vane guide 321 are visible in FIG. 11). The motor 320 also includes a front cover 326 and a rear cover 328 each secured to the housing 323.

Each vane 322 is split. In particular, each vane 322 comprises a first portion 330 and a second portion 332. The first and second portions 330, 332 are configured so that the second portion 332 is nested partially within the first portion 330, and can slide forward and rearward, i.e., left-right from the perspective of FIG. 11, in and out of the first portion 330.

The interior of the first portion 330 of the vane 322 can be filled with compressed air that urges the second portion 332 rearward, toward the rear cover 328, in relation to the first portion 330. This feature causes the forward edge of the first portion 330 and the rearward edge of the second portion 332 to remain in contact with the adjacent surfaces of the respective front cover 326 and rear cover 328 as the vane 322 and the adjacent surfaces wear, thereby maintaining a seal between the vane 322 and the adjacent surfaces. The forward edge of the first portion 330 and the rearward edge of the second portion 332 are depicted in FIG. 11 as spaced apart from the adjacent surfaces of the respective front cover 336 and rear cover 338 for clarity of illustration.

Compressed air can be ducted to the interior of the first portion 330 of the vane 322 by way of the interior of the shaft 325, and an opening 335 formed in the shaft 325 adjoining the interior of the first portion 330. The compressed air can be vented from the interior of the first portion 330 by way of an opening 337 formed in the first portion 330.

The second portion 332 of each vane 322 can be biased in the rearward direction by springs located within the first portion 330, in lieu of compressed air.

The vanes 322 and/or the front cover 326 and rear cover 328 (or the contacting surfaces thereof) can be formed from a self-lubricating material such as silicon carbide. Alternatively, the vanes 322 and/or the front cover 326 and rear cover 328 can be formed from a relatively inexpensive material such as steel, and a suitable lubricant such as NEVER-SEEZE® can be sprayed onto the contacting surfaces of the vanes 302, the front rear cover 326, and the rear cover 328 on an intermittent basis during operation of the motor 320.

PARTS LIST

Engine system 10
Compressor 22
Air-storage tank 23
Combustor 24
Rotary vane motor 26
Load 27
Exhaust source 28
Combustion chamber 30 of combustor 24
Fuel source 32
Ignition source 34
Rotor 44
Shaft 45
Housing 46
Barriers 47
Interior surface 48 of housing 46
Chamber 49
Inlet 50
Outlet 52
Outer casing 54
Vent openings 56
Ports 57
Vane guides 58
Vane slots 60
Vanes 62
First cover 64
Opening 65 in first cover 64
Second cover 66
Rings 67
Chambers 68
Openings 69 in rings 67
Springs 71
Bearing 72
Openings 73 in first and second covers 64, 66 and rings 67
Hydraulic actuators 74
Springs 75
Controller 76
Source of pressurized hydraulic fluid 77
Valving 79
Processor 81
Memory-storage device 83
Position sensors 85
Manifold 89
Piping 90

What is claimed is:

1. A rotary vane engine, comprising:

a housing;

a rotor mounted within the housing and rotatable in relation to the housing about an axis of rotation, the rotor comprising a shaft and plurality of vanes mounted on the shaft, the vanes and the housing defining a plurality of chambers each having a volume that receives a pressurized gas for expansion within the chamber to impart rotation to the rotor, wherein:

an inlet and an outlet are formed in the housing;

the inlet receives the pressurized gas and directs the pressurized gas to the chambers before the pressurized gas has been expanded;

the pressurized gas is exhausted from the chambers by way of the outlet after the pressurized gas has been expanded;

one or more vent openings are formed in the housing at circumferential positions located between the outlet and the inlet in the direction of rotation of the rotor; and one or more ports are formed in the housing at circumferential positions located between the inlet and the outlet in the direction of rotation of the rotor;

at least one of: a hydraulic actuator; a screw jack; a pneumatic cylinder; a cam; a ramp; and a lobe coupled to the rotor for moving the rotor in a direction substantially perpendicular to the axis of rotation so that a volume of each of the chambers at a given angular position of the chamber in relation to the housing is variable and an expansion ratio of the pressurized gas is variable;

a manifold in fluid communication with the one or more vent openings and the one or more ports; and a controller that causes the manifold to direct the pressurized gas from the one or more vent openings to the one or more ports.

2. A rotary vane engine, comprising:

a first and a second cover, the first cover being secured to one end of the housing, the second cover being secured to another end of the housing, the first and second covers each having an opening formed therein proximate an outer periphery thereof; and a rotor mounted for rotation within the housing and comprising a shaft and a plurality of vanes mounted on the shaft, wherein:

the vanes and the housing define a plurality of chambers for expanding a pressurized gas to impart rotation to the rotor;

a centerline of the shaft is movable in relation to the housing in a direction substantially perpendicular to a centerline of the housing so that a volume of each of the chambers at a given angular position of the chamber is variable and an expansion ratio of the pressurized gas is variable;

each of the vanes and the vane guides extends substantially in a first direction between a leading and a trailing edge thereof, the first direction being disposed at an angle greater than zero and less than 90° in relation to a direction coinciding with the centerline of the shaft;

an inlet and an outlet are formed in the housing;

one or more vent openings are formed in the housing at circumferential positions located between the outlet and the inlet in the direction of rotation of the rotor;

the inlet receives the pressurized gas and directs the pressurized gas to the chambers before the pressurized gas has been expanded; and at least a portion of the pressurized gas is exhausted from the chambers by way of the outlet after the pressurized gas has been expanded.

3. The rotary vane engine of claim 2, wherein the vane guides are configured to rotate in relation to the centerline of the shaft so that the angle between the first direction the direction coinciding with the centerline of the shaft can be varied during operation of the rotary vane engine.

4. The rotary vane engine of claim 3, wherein each of the vanes has a first portion, and a second portion partially nested within the first portion so that the first and second portions can move in relation to each other in the first direction.

5. The rotary vane engine of claim 4, wherein the first portion of each of the vanes is biased toward the first cover, and the second portion of each of the vanes is biased toward the second cover.

6. A rotary vane engine adapted for use with a source of pressurized gas, comprising:

a housing; and a rotor mounted in the housing and rotatable in relation to the housing about an axis of rotation, wherein:

the rotor comprises a shaft, a plurality of radially-oriented vane guides secured to the shaft, and a plurality of vanes;

each of the plurality of vanes is disposed at least in part within an associated one of the vane guides;

the vanes, the vane guides, and the housing define a plurality of chambers within the rotary vane engine;

the chambers receive pressurized gas from the source of pressurized gas;

the pressurized gas is expanded within the chambers to impart rotation to the rotor;

the rotor is movable in relation to the housing in a direction substantially perpendicular to the axis of rotation of the rotor so that a volume of each of the plurality of chambers at a given angular position of the chamber in relation to the housing is variable and an expansion ratio of the pressurized gas is variable;

an inlet and an outlet are formed in the housing;

the inlet receives the pressurized gas and directs the pressurized gas to the chambers before the pressurized gas has been expanded;

the pressurized gas is exhausted from the chambers by way of the outlet after the pressurized gas has been expanded;

one or more vent openings are formed in the housing at circumferential positions located between the outlet and the inlet in the direction of rotation of the rotor;

one or more ports are formed in the housing at circumferential positions located between the inlet and the outlet in the direction of rotation of the rotor; and the rotary vane engine further comprises a manifold in fluid communication with the one or more vent openings and the one or more ports, and a controller that causes the manifold to direct the pressurized gas from the one or more vent openings to the one or more ports.

7. The rotary vane engine of claim 6, wherein the vanes are slidably disposed within associated ones of the vane guides so that the vanes move radially outward and inward in relation to the associated vane guides in response to centrifugal force acting on the vanes and rotation of the rotor.

8. The rotary vane engine of claim 6, wherein the vanes have rounded tips.

9. The rotary vane engine of claim 6, further comprising a first and a second cover each secured to the housing, and a first and a second ring, the first ring being positioned between the first cover and the vane guides and vanes, and the second ring being positioned between the second cover and the vane guides and vanes.

10. The rotary vane engine of claim 9, wherein the rings are mounted on springs that urge the rings toward the vanes and the vane guides.

11. The rotary vane engine of claim 6, wherein the vanes are biased radially outward in relation to the vane guides.

12. The rotary vane engine of claim 6, wherein the vanes and vane guides are angled in their respective lengthwise directions in relation to a centerline of the shaft.

13. The rotary vane engine of claim 6, wherein the housing and the rotor are formed from one or more self-lubricating materials.

14. The rotary vane engine of claim 6, wherein the housing and the rotor are formed from one or more non-self-lubricating materials treated with a lubricating compound.

15. The rotary vane engine of claim 6, further comprising at least one of: a hydraulic actuator; a screw jack; a pneumatic cylinder; a cam; a ramp; and a lobe mechanically coupled to the rotor and the housing for moving the rotor in relation to the housing in the direction substantially perpendicular to the axis of rotation.

16. The rotary vane engine of claim 15, further comprising a controller that controls the at least one of a hydraulic actuator; a screw jack; a pneumatic cylinder; a cam; a ramp; and a lobe to position the rotor at the desired position in relation to the housing.

17. The rotary vane engine of claim 6, further comprising a bearing that supports the rotor in a cantilevered manner.

18. The rotary vane engine of claim 6, further comprising a first and a second cover secured to the housing, wherein the vanes have an upper portion shaped substantially as a trapezoid, and the first and second covers are angled so that an orientation of the first and second covers substantially matches an orientation of respective forward and rearward edges of the upper portions of the vanes whereby the forward and rearward edges and outer edges of the vanes remain in contact with adjacent surfaces of the respective first cover, second cover, and housing due to centrifugal force as the forward, rearward, and outer edges and the adjacent surfaces of the first cover, second cover, and housing wear, thereby maintaining a seal between the vanes and the first cover, second cover, and housing.

19. The rotary vane engine of claim 6, further comprising a first and a second cover secured to the housing, wherein: the vanes comprise a first portion, and a second portion disposed in part within the first portion; and the second portion is biased away from the first portion whereby an edge of the first portion and an edge of the second portion remain in contact with adjacent surfaces of the respective first and second covers as the edges of the first and second portions and adjacent surfaces of the first and second cover wear, thereby maintaining a seal between the vane and the first and second covers.

* * * * *